United States Patent [19]

Ahrens

[11] 4,286,781

[45] Sep. 1, 1981

[54] PLAYGROUND MERRY-GO-ROUND

[75] Inventor: Paul W. Ahrens, Grinnell, Iowa

[73] Assignee: Miracle Recreation Equipment Company, Grinnell, Iowa

[21] Appl. No.: 84,052

[22] Filed: Oct. 11, 1979

[51] Int. Cl.[3] ..... A63G 1/14

[52] U.S. Cl. ..... 272/33 R; 273/DIG. 4

[58] Field of Search ..... 272/33 R, 33 A, 33 B, 272/39, 43; D21/93, 242, 243, 247, 249

[56] References Cited

U.S. PATENT DOCUMENTS

| | | | |
|---|---|---|---|
| 1,130,217 | 3/1915 | Tothill | 272/33 R |
| 1,826,468 | 10/1931 | Hoppes | 272/33 R |
| 1,860,194 | 5/1932 | Maloney | 272/33 R |
| 1,925,324 | 9/1933 | Humphrey | 272/33 R |
| 2,686,674 | 8/1954 | Behrens | 272/33 R |
| 3,075,762 | 1/1963 | Ahrens | 272/39 |
| 3,510,127 | 5/1970 | Wormser | 272/33 R |
| 3,511,498 | 5/1970 | Ahrens | 272/33 R |

*Primary Examiner*—Richard C. Pinkham
*Assistant Examiner*—Arnold W. Kramer
*Attorney, Agent, or Firm*—Zarley, McKee, Thomte, Voorhees & Sease

[57] ABSTRACT

A molded plastic body includes four sections having inter frame members bolted together adjacent the periphery. A channel cap extends from a center hub over abutting body section edges and through a downwardly extending fin and is connected to the inter frame members. Each of the body sections includes a railing extending from the top of the hub outwardly and then downwardly into two peripherally spaced apart leg portions connected to the floor of the body section. The connections of the inter frame members are in recesses formed in the body sections allowing access by tools for assembly purposes.

10 Claims, 5 Drawing Figures

PLAYGROUND MERRY-GO-ROUND

BACKGROUND OF THE INVENTION

Merry-go-round playground equipment is very popular among children but can be dangerous when children get underneath the equipment and are injured by the protruding edges of the metal body. The metal bodies are also very heavy and expensive and difficult to fabricate, ship and assemble. Playground equipment needs to be safe to use, inexpensive to fabricate, easy to assemble and durable in use.

SUMMARY OF THE INVENTION

The body section of the merry-go-round of this invention is formed of a rotational molded polyethylene plastic and presents a completely enclosed merry-go-round with no open areas or rough frame work exposed to cause any injuries to children even if they should get underneath the equipment. An inter frame member is provided in each of the four body sections and includes end plates positioned in recesses having exposure from the underneath for connecting the end plates together. The abutting edges of the body sections are covered by a channel cap connected at its inner end to a centrally disposed hub and at its outer end to the inter frame members through a downwardly extending fin. Each of the body sections includes a railing extending from the top of the hub horizontally outwardly and then downwardly where it merges into two peripherally disposed legs connected to the platform of the body section thereby providing structural strength to the body and also a handhold for the users of the equipment.

DESCRIPTION OF THE PREFERRED EMBODIMENT

Figure 1:
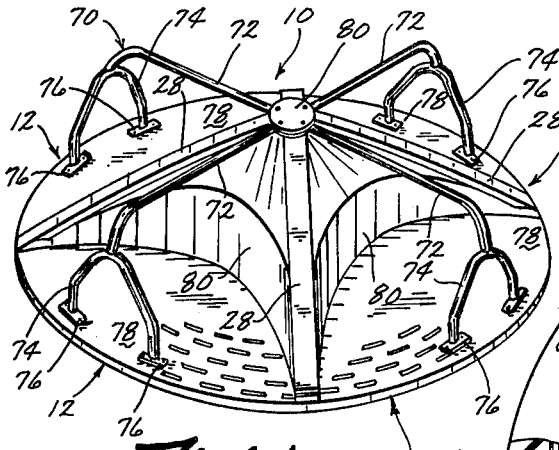
FIG. 1 is a perspective view of the playground merry-to-round.

The playground merry-go-round of this invention is referred to generally in FIG. 1 by the reference numeral 10 and includes four identical quarter body sections 12 molded out of polyethylene plastic using a rotational mold process to provide a high strength piece of playground equipment which is resistant to extreme use and weather conditions.

Figure 2:
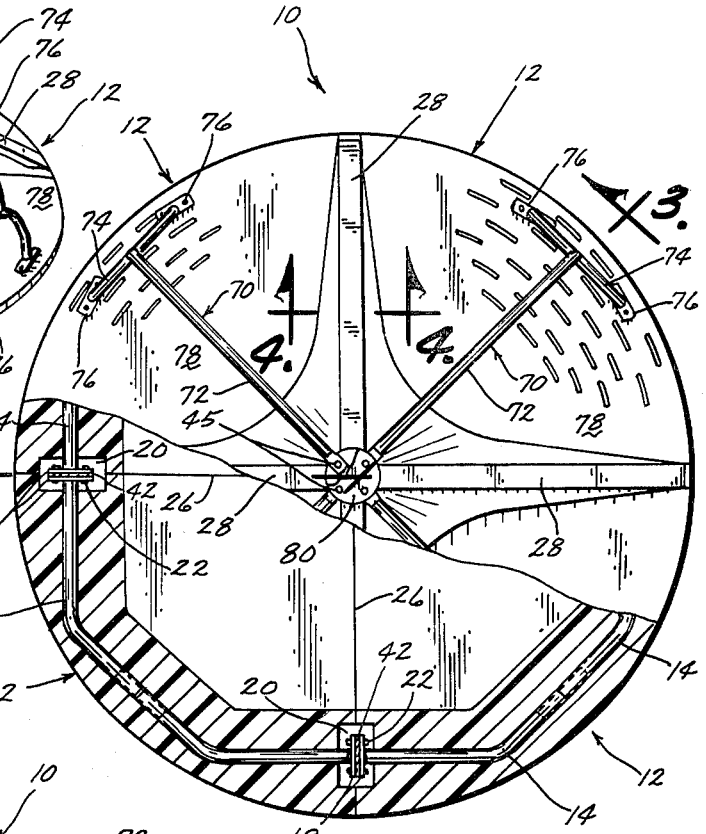
FIG. 2 is a fragmentary top plan view thereof with a portion broken away to illustrate the inner inter frame members connecting the body sections together.
Figure 4:
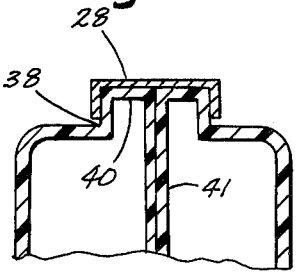
FIG. 4 is a cross-sectional view taken along line 4—4 in FIG. 2.
Figure 3:
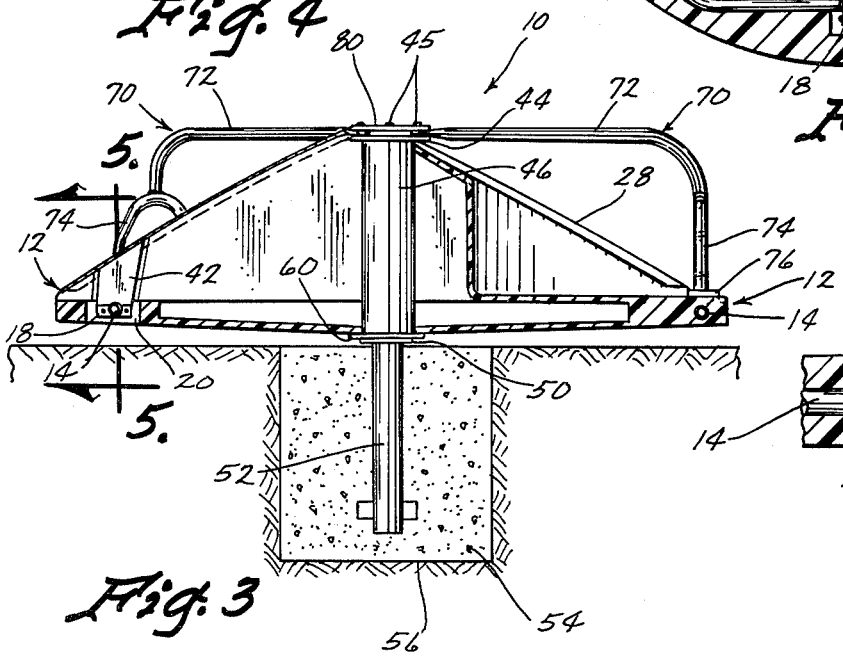
FIG. 3 is a cross-sectional view taken along line 3—3 in FIG. 2.
Figure 5:
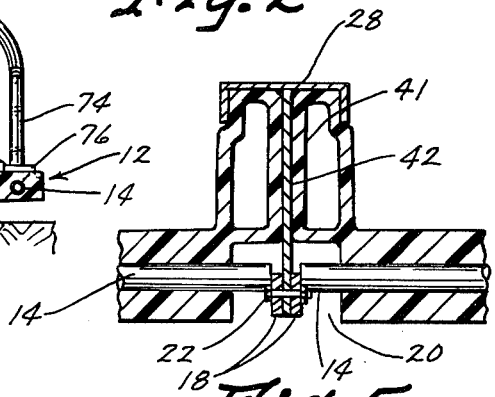
FIG. 5 is a cross-sectional view taken along line 5—5 in FIG. 3.

Each of the body sections 12, as seen in FIG. 2, include an inter frame member 14 molded therein (FIG. 3) adjacent the outer peripheral edge. The frame member 14 is provided with end plates 18 disposed in a recess 20 giving access to bolts 22 connecting end plates 18 of adjacent inter frame members 14, as seen in FIG. 5.

Adjacent abutting sides 26 (FIG. 2) are covered by a channel cap 28. The sides of the body sections 26 include upstanding portions 38 which merge into horizontally extending portions 40 and downwardly extending portions 41 which abut each other on adjacent body sections. The outer end of the channel cap 28 includes a downwardly extending fin or gusset 42 which is connected between the end plates 18 by the bolts 22, as seen in FIG. 5. The inner end of the channel cap 28 is bolted to a top horizontally disposed flange or collar 44 by bolts 45. The collar 44 is welded to a hub 46 having bearings in either end and supported on a support collar 50 welded onto a post shaft 52 set in concrete 54 in the ground 56.

The inner ends of the quarter body sections 12 are arcuately shaped to matingly engage the circular hub 46 and are disposed on a flange 60 spaced above the support collar 50 on the post shaft 52. The bearing in the lower end of the hub engages the support collar to space the lower end of the hub from the support collar 50. The upper inner surface of the body sections 12 are positioned under the bolt collar 44.

Each body section 12 includes a railing structure 70 comprising a horizontally extending portion 72 having its inner end connected to the collar 44 on the hub 46 between adjacent inner ends of channel caps 28, as seen in FIG. 2. The portions 72 merge into a pair of peripherally spaced apart legs 74 connected by feet 76 to the platform 78 of the body section 12 and provides structural strength for the body section as well as handholds for the users of the equipment.

The assembly of the merry-go-round is completed by the attachment of a cap plate 80 using the bolts 45 which extend through the cap plate and through the inner ends of the railings 70 and the cap channels 28 into threaded apertures in the bolt collar 44 welded to the hub 46.

Thus it is seen that a simplified knockdown type of playground equipment is provided assembled from common parts utilizing modern fabricating methods wherein rotational molding is utilized working with polyethylene plastic to provide a strong weather and child resistant piece of equipment. Each of the body sections 12 includes a flat platform area 78 and a concave curved vertical wall 80 thus providing dished out stations around the periphery of the merry-go-round. The railing structure 70 not only strengthens the entire piece of equipment but provides handholds for the users with the legs 74 additionally functioning as a guard rail preventing children from falling off in response to centrifugal forces generated as the merry-go-round is rotated.

I claim:

1. A playground merry-go-round comprising, a stationery post, a merry-go-round body having a center hub assembly being rotatably mounted on said post, said body including a plurality of pie-shaped body sections having oppositely disposed side edges in abutting engagement with adjacent body sections, connecting means interconnecting adjacent body sections, and said body sections being formed from molded plastic material and including a rigid inter frame member molded into the body section adjacent the outer periphery thereof, said inter frame member having oppositely disposed end plates positioned in recesses formed in said body sections and said connecting means interconnecting said end plates, and said recesses being shaped to expose said end plates from below said body sections for operation of said connecting means.

2. The structure of claim 1 wherein said body sections are substantially smooth on the underside to provide a smooth bottom side for said merry-go-round body.

3. The structure of claim 1 and a channel cap having inner and outer ends embracingly engages from above adjacent side edges of said body sections and is connected to said hub assembly at its inner end, said channel cap includes at its outer end a depending fin connected to said end plates by said connecting means.

4. The structure of claim 3 wherein said plurality of body sections is further defined as four body sections.

5. The structure of claim 3 wherein said stationery post includes a support collar adjacent the ground and said hub assembly includes a hub mounted on said post and supported by said collar.

6. The structure of claim 5 wherein said hub assembly includes a hub having top and bottom flanges with said body sections having inner ends shaped to matingly engage said hub and supportingly rest on said bottom flange, and said channel caps having their inner ends connected to said upper flange on said hub.

7. The structure of claim 6 wherein a railing structure is provided including a plurality of radially disposed uniformly spaced apart members having inner and outer ends, said inner ends being connected to said upper flange on said hub and said outer ends connected to the associated body section adajcent its outer peripheral edge.

8. The structure of claim 7 wherein a railing member is provided for each body section.

9. The structure of claim 8 wherein said railing member includes a horizontally extending portion extending from said upper flange and terminating in a downwardly extending portion having peripherally spaced apart feet elements connected to the top surface of said associated body section.

10. A playground merry-go-round comprising, a stationery post, a merry-go-round body having a center hub assembly being rotatably mounted on said post, said body including a plurality of pie-shaped body sections having oppositely disposed side edges in abutting engagement with adjacent body sections, connecting means interconnecting adjacent body sections, and said body sections including a rigid inter frame member within the body section adjacent the outer periphery thereof, said inter frame member having oppositely disposed end plates positioned in recesses formed in said body sections and said connecting means interconnecting said end plates, and said recesses being shaped to expose said end plates from below said body sections for operation of said connecting means.

* * * * *